United States Patent [19]

Armond et al.

[11] Patent Number: 4,470,094

[45] Date of Patent: Sep. 4, 1984

[54] DEMAGNETIZING APPARATUS AND METHOD

[75] Inventors: Joseph A. Armond, River Grove; Gabriel R. Buky; Fred Patrick, both of Chicago, all of Ill.

[73] Assignee: Electro-Matic Products Co., Chicago, Ill.

[21] Appl. No.: 382,678

[22] Filed: May 27, 1982

Related U.S. Application Data

[63] Continuation-in-part of Ser. No. 167,937, Jul. 14, 1980.

[51] Int. Cl.[3] ..... H01F 13/00

[52] U.S. Cl. ..... 361/149; 361/151

[58] Field of Search ..... 361/143, 149, 151, 180; 198/341, 467, 469

[56] References Cited

U.S. PATENT DOCUMENTS

| | | | |
|---|---|---|---|
| 3,421,053 | 1/1969 | Rinard | 361/149 |
| 3,461,353 | 8/1969 | Thorson | 361/180 |
| 3,506,884 | 4/1970 | McKinley | 361/151 |
| 3,727,075 | 4/1973 | Buckley | 361/180 |
| 3,938,011 | 2/1976 | Littwin | 361/151 |
| 4,053,849 | 10/1977 | Bower | 361/180 |
| 4,269,298 | 5/1981 | Mergl | 198/341 |

FOREIGN PATENT DOCUMENTS

| | | | |
|---|---|---|---|
| 526959 | 8/1976 | U.S.S.R. | 361/149 |
| 612427 | 7/1978 | U.S.S.R. | 361/149 |

OTHER PUBLICATIONS

W. F. Bower, "Demagnetizing Parts . . . ," *Electrical World*, Feb. 2, 1946.

*Primary Examiner*—G. Z. Rubinson
*Assistant Examiner*—L. C. Schroeder
*Attorney, Agent, or Firm*—Paul H. Gallagher

[57] ABSTRACT

A machine having a conveyor for carrying a workpiece to be magnetized therethrough. It includes two demagnetizing magnets arranged at a mutual angle of 90° and both at 45° to the direction of travel on the conveyor. The magnets are arranged respectively above and below the conveyor, and hence above and below the workpiece on the conveyor, and are spaced apart in the direction of travel of the conveyor. The conveyor, structurally, includes a stationary base, and endless belts carrying paddles, the paddles engaging the workpieces and moving them along the base. The workpieces "float," capable of moving to any position according to the condition of magnetism in them and the position and shape of the demagnetizing magnets, and upon encountering the field of the demagnetizing magnet that is disposed above the workpieces, the workpieces are capable of being attracted up to that demagnetizing magnet, off of the base of the conveyor.

11 Claims, 11 Drawing Figures

DEMAGNETIZING APPARATUS AND METHOD

This application is a continuation-in-part of our prior and co-pending application Ser. No. 167,937, filed July 14, 1980.

FIELD OF THE INVENTION

The invention resides in the large field of demagnetizing or degaussing. In the industrial field, particularly, magnetization of various and many items takes place, both incidentally or accidentally, and deliberately. They must then be demagnetized, but many times demagnetizing presents difficulties, such as in cases of articles of great mass. Another great difficulty has to do with shielding effects in articles that are made up of unlike parts. For example, in bearings, or bearing assemblies, made up of rollers, cages, rings, races, etc., all of the different components become magnetized, but to different effects, because of mass, shape, position relative to each other, and some of them may produce a shielding effect on others.

OBJECTS OF THE INVENTION

A main and broad object of the invention is to provide novel apparatus and method for demagnetizing articles that because of their nature are particularly difficult to demagnetize, having novel features, effective for the purpose of:

(a) A special arrangement of demagnetizing units specially arranged in angular relation to the passage of the articles along the line of travel for producing the demagnetizing effect;

(b) Novel method of applying demagnetizing forces to the articles to be demagnetized, that is unusually effective in the case of such articles made up of elements of unlike character that produce shielding effects relative to each other, and the demagnetizing function is effective notwithstanding such shielding effects;

(c) A novel arrangement of conveying articles to be demagnetized, including a special conveyor structure, and arrangement of demagnetizing magnets, in the use of which the articles are free to float and hence find positions, relative to the demagnetizing magnets, according to the magnetization of the articles.

DESCRIPTION OF THE PREFERRED EMBODIMENT

Figure 1:
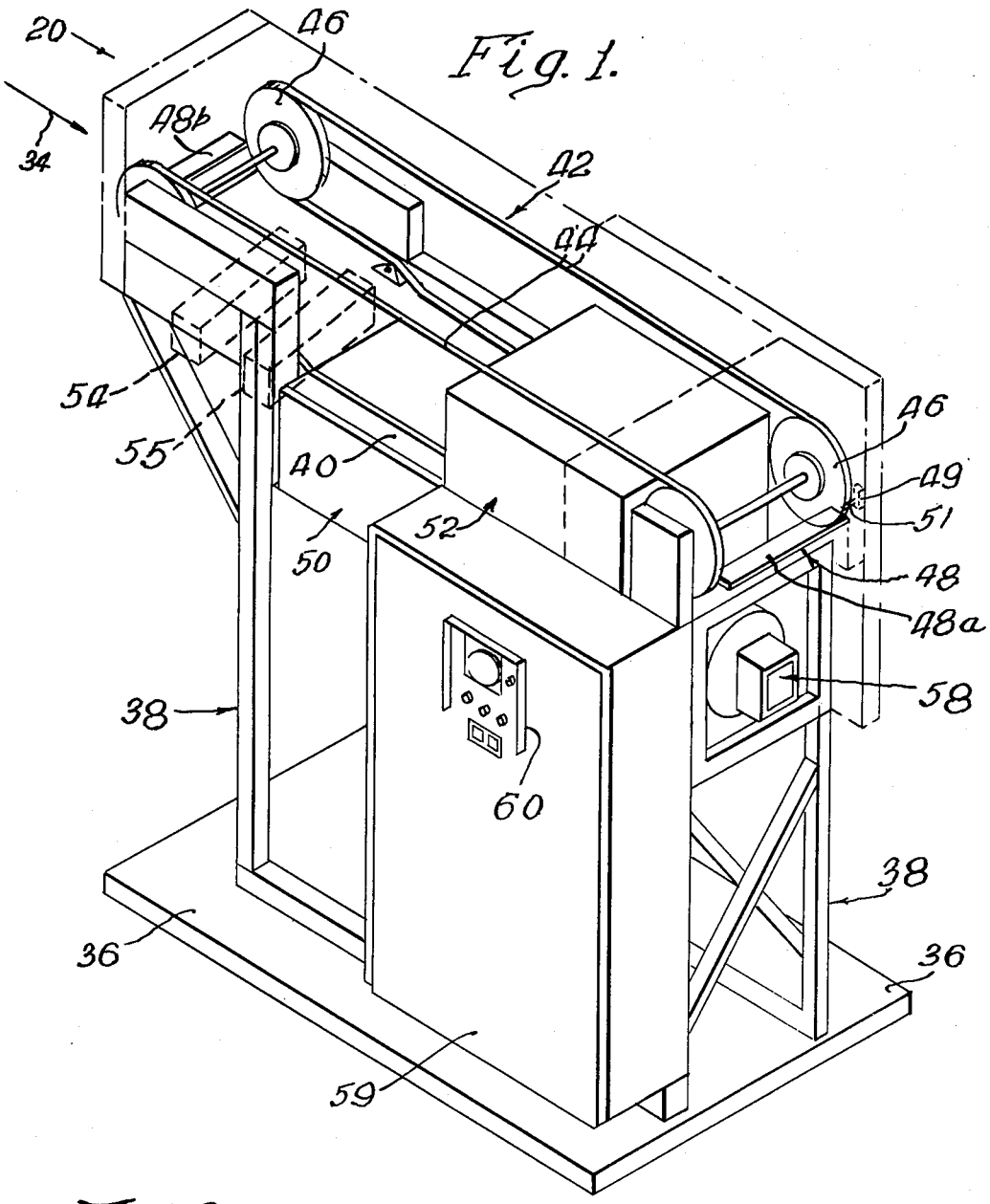
FIG. 1 is a perspective view of the apparatus of the invention.

Referring in detail to the drawings, FIG. 1 shows the apparatus as a whole, indicated in its entirety at 20, into which the workpiece to be demagnetized is placed, and conveyed therethrough.

Figure 5:
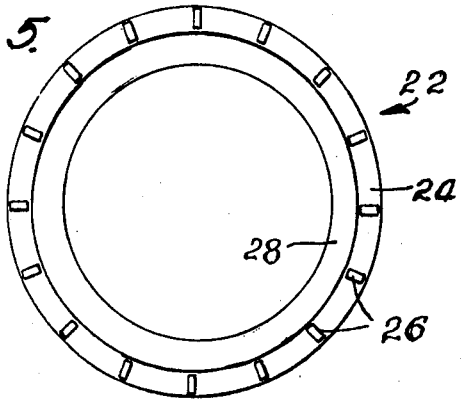
FIG. 5 is a top view of the workpiece of FIG. 4.
Figure 4:
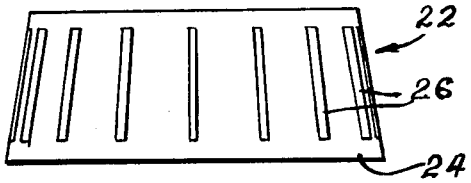
FIG. 4 is a side view of a workpiece to be demagnetized.
Figure 6:
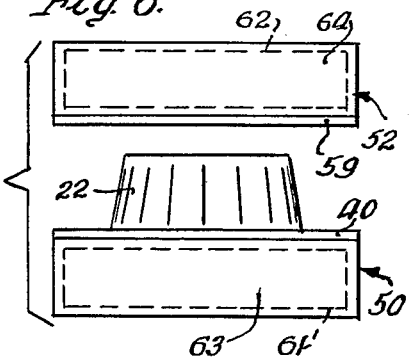
FIG. 6 is a semi-diagrammatic view oriented according to line 6—6 of FIG. 2.

FIGS. 4 and 5 show a workpiece 22, which in the present instance is a bearing, and as such is extremely difficult to demagnetize. The bearing 22 is a well-known and conventional roller bearing and includes as individual parts or elements, a roller cage 24 in which are a plurality of rollers 26, and a bearing race 28. These various components or elements are all of magnetic material, usually steel, but they are magnetized in different ways, or to different effects, for various reasons, including for example the shapes of the different elements, the size and mass thereof, and their location relative to one another in the bearing assembly. The reasons why these different elements are magnetized differently, and why they render it difficult to demagnetize the complete workpiece, need not be entered into, but it is desired to emphasize the extreme difficulty encountered usually in demagnetizing such a workpiece. It has been found in demagnetizing such a bearing by apparatus and methods heretofore used, that following a demagnetizing step being performed on it, a test shows then to be non-magnetized, but when the parts thereof were rotated relative to each other, a test showed it to be still magnetized. It is believed that this was due to a shielding effect of some of the parts on others. The apparatus and method of the present invention overcome that difficulty.

In the operation of the apparatus, in demagnetizing the workpiece, the workpiece is placed in the apparatus and it is carried therethrough by conveyor means. The apparatus may constitute one unit in an overall production line or assembly line, and as such may be arranged as in FIGS. 2 and 3, where a unit or conveyor 30 carries the workpiece into the apparatus 20, and then it is conveyed through the apparatus to another unit or conveyor 32, in a known manner. The direction of conveyance of the workpiece through the apparatus, and through the production line, is indicated by the arrows 34, also shown in FIG. 1, the apparatus thus having an entry end at the left and an exit end at the right.

Mechanically, the apparatus 20 may be constructed and arranged in any suitable manner, having a base 36 and a stand or frame 38. Incorporated in the stand 38 is a conveyor means indicated in its entirety at 39, which is provided with special structure for facilitating the handling of the workpieces, as the latter are conveyed, in a special manner for demagnetizing them according to the nature of the present invention. The conveyor means includes a stationary base 40 in the form of a flat board or platform, of nonmagnetic material, on which the workpiece is placed. The conveyor means 39 includes a movable component 42, which itself includes a pair of endless belts or chains 44 mounted on rollers or sprockets 46 on transverse axes, the belts extending essentially the full length of the frame. The belts are provided with two nonmagnetic paddles 48 individually identified **48*a* and 48*b*, at spaced positions, such as equidistantly in both directions around the conveyor belt. The paddles 48 may be utilized to accuate a limit switch 49 having a lever or actuating element 51 engaged by the paddles for performing a control operation in the unit 20** or the assembly line in which it is incorporated.

Incorporated in the apparatus 20 are demagnetizing units 50 and 52. These units are of special construction and arrangement for carrying out the novel features of the invention as will be described in detail hereinbelow. The unit 50 is positioned below the conveyor base 40 while the unit 52 is above it, the two units being spaced longitudinally in the direction of movement of the workpiece through the apparatus, and therefore the lower unit 50 is relatively anterior and the upper unit 52 relatively posterior, oriented to that direction of movement.

The apparatus 20, of FIG. 1, may also include various other units and components, such as a pair of sensor units, a lead-in unit 54 and a transfer unit 55, which may be mounted under the conveyor base 40 adjacent the entry end of the apparatus, for performing related control functions.

Figure 2:
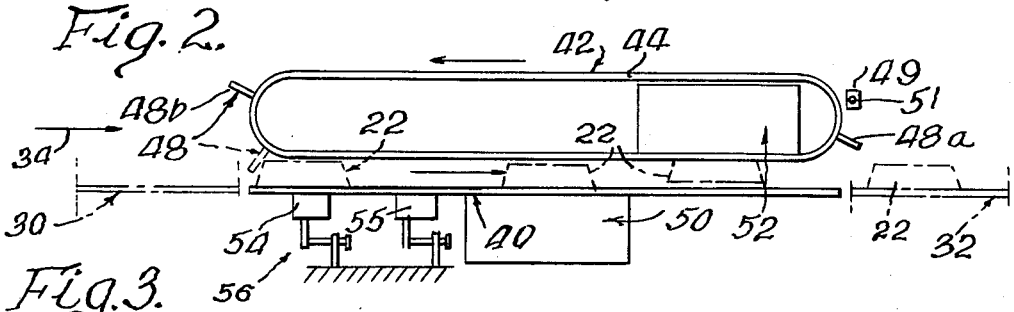
FIG. 2 is a semi-diagrammatic elevational view of the apparatus of FIG. 1 taken from the lower left of the latter figure.

The conveyor component 42 is driven by an electric motor 58, preferably DC and of variable speed, the component 42 being driven in counterclockwise direction, as viewed in FIG. 2, and the workpieces 22 are thus moved or conveyed from left to right.

Figure 7:
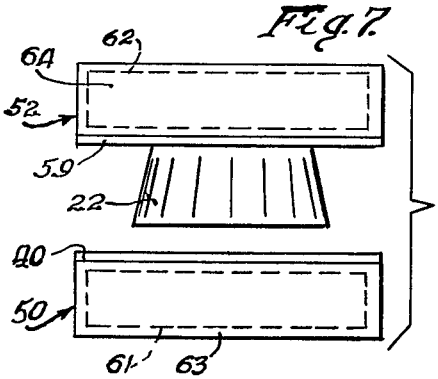
FIG. 7 is a view similar to FIG. 6 but with the work piece in a raised position.

The units 50, 52, as indicated above, include special construction, and are arranged in a particular way. The units include demagnetizing coils 61, 62, respectively and are mounted in casings or housings 63, 64 respectively. The conveyor base or board 40 constitutes the top or closure element of the lower cabinet 63 and the workpieces 22 rest on the base 40, at least at times and when so resting, are in close proximity to the coil 61 in the lower cabinet. In a similar manner, the upper casing 64 includes a bottom closure element 59 which is of nonmagnetic material. As will be referred to again hereinbelow, the workpiece, at times, is lifted off of the supporting base 40, up toward the upper magnet, and when in that position engages the element 59. In a condition similar to that of the first unit 50, the magnet 62 in the upper unit is close to the closure element 59, and when the workpiece is in the upper position as shown in FIG. 7, and engaging the element 59, it is in close proximity to the magnet 62 in the upper unit. The casings or housings 63, 64 may assume any desired physical structure other than the detail features just described.

Figure 8:
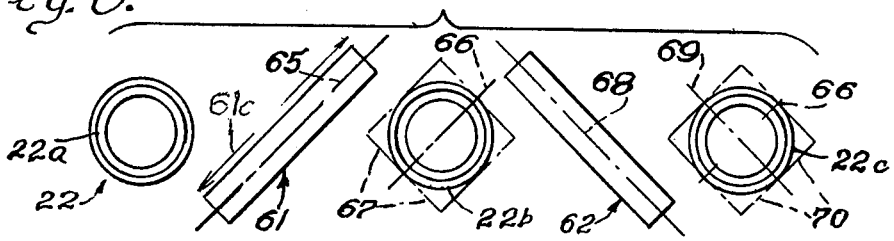
FIG. 8 is a semi-diagrammatic view oriented according to FIG. 3, showing the demagnetizing units and a workpiece in different positions relative thereto.
Figure 9:
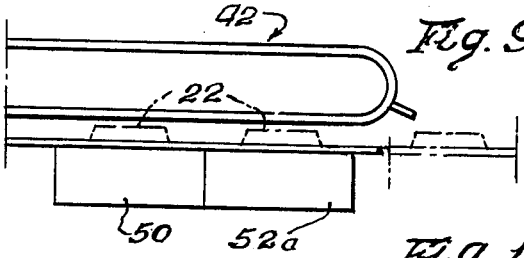
FIG. 9 is a fragmentary view, similar to FIG. 2, showing a slightly modified form.

FIG. 9 illustrates a preferred form of demagnetizing magnet, 61, 62 utilized in the units 50, 52. This magnet is of the surface kind including pole pieces 61*a* and a coil 61*b*. The magnet is preferably substantially elongated in the direction of the arrows 61*c* (FIG. 8). The pole pieces 62*a* have upper surfaces 61*d* which define the effective surface of the magnet, that is, the surface nearest the workpiece as the latter moves along through the apparatus, these being the upper surface of the first magnet 61 and the lower surface of the magnet 62. FIG. 9 indicates the position of the workpiece 22, relative to the magnet, as the workpiece is moving through the unit 20, being spaced therefrom effectively only the distance equal to the thickness of the element 40, 59.

The surface magnets 61, 62 constitute an advantageous feature of the invention. A surface type magnet provides lines of force indicated at 61*e* passing between the pole pieces 61*a*, 61*b*, and thus lying essentially in planes transverse to the length of the magnet. These lines of force, in the region of the workpiece, pass through the workpiece, and provide demagnetizing effect much greater than magnets of other kinds heretofore used.

Figure 3:
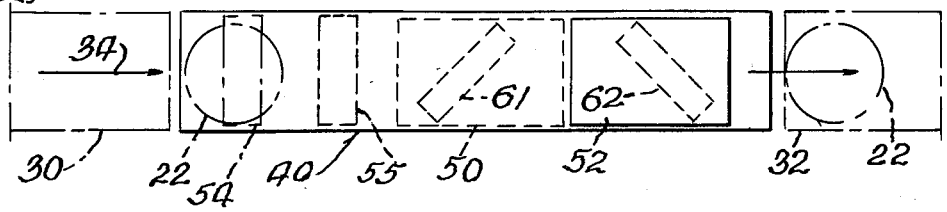
FIG. 3 is a semi-diagrammatic top view of the apparatus of FIG. 1.

The elongation proportion of the magnets is brought out particularly in FIG. 8. The demagnetizing coils 61, 62, in the units 50, 52, are arrranged, as illustrated in that figure in a mutual angular spacing of 90°, and both are disposed at 45° to the direction of travel of the conveyor. These coils 61, 62 are AC, and in subjecting the workpiece 22 thereto, the AC cycle reversals produce the demagnetizing effect, which is produced specifically in conjunction with the movement of the workpieces away from the demagnetizing coils. Referring to FIGS. 2 and 3, the workpieces 22 are moved along toward and past the demagnetizing units 50, 52, and as they recede from the units the magnetic field intensity decreases, and in each successive field reversal, the remagnetizing effect is reduced, resulting in a final zero magnetism as the workpiece is moved farther away.

Because of the diagonal disposal of the coils 61, 62, a special demagnetizing effect is produced. FIG. 8 shows a workpiece 22 at position 22*a* in magnetized position. It approaches the first demagnetizing coil 61, and due to the position and arrangement of the coil and laminations, a region of lesser intensity of the electro-magnetic field is found along the central line 65, and the demagnetizing effect on the workpiece is at a minimum at a corresponding line 66 in the workpiece, shown at position 22*b*, which coincided with the line 65. In other words, the workpiece would be demagnetized on opposite sides of the line 66, in the areas indicated by the boxed lines 67, but there may be residual magnetism along the line 66. As the workpiece goes from position 22*b* toward and into demagnetizing position relative to the coil 62, the coil 62 has a demagnetizing effect at right angles to that of the coil 61. In the coil 62, the central line 68 has a corresponding effect on the workpiece, indicated at position 22*c*, and in this case the line 69 through the workpiece coincided with the line 68 in the coil 62. In a similar manner any residual magnetism would reside in the line 69 or in the neighborhood thereof, while on both sides of that line the magnetism would be substantially completely dissipated in the areas indicated by the boxed lines 70. These side portions being so demagnetized, would remove any magnetism that resided in the transverse direction in the neighborhood of the first line 66. Thus the regular angular position of the coils 61, 62, provides complete demagnetization in the directions noted, and their positions respectively below and above the workpiece in the conveyor, completes the demagnetization of the workpiece in all other directions, supplementing each other.

Figure 10:
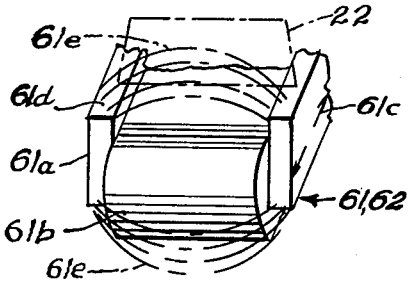
FIG. 10 is an isolated view of a demagnetizing magnet and a workpiece, in certain demagnetizing interrelation.
Figure 11:
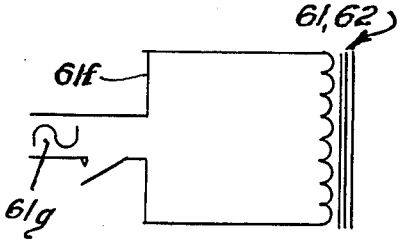
FIG. 11 is a fragmentary circuit including a demagnetizing magnet.

FIG. 10 shows a magnet 61 (or 62) in a fragment of a circuit 61*f* energized by an AC source 61*g*.

The "floating" effect of the workpieces constitutes an important feature of the invention. This feature is directly associated with the complex structure of the workpiece, forming the example in the present case, namely a bearing. As is generally known, a bearing, after having been magnetized, is extremely difficult to demagnetize. Among the various reasons for this difficulty is the structural complexity of the bearing, including the bearing races, the bearing rollers, which are movable relative to each other, and the different components being of different shape, mass, etc. In perfecting the present invention it is found that such bearings possess magnetism in different areas, amounts, effects, etc., including localized opposed poles, in corresponding fields, at different locations in the workpiece. In moving or transporting or conveying the workpieces through the apparatus it is not always effective to position the workpieces in any certain attitude relative to the demagnetizing magnets, one of the reasons being that it is not known where all of the local areas of magnetization reside, and the lines in the magnetic field do not turn abruptly to reach all hidden corners in the complex workpiece—the bearing. It has been found that if the workpieces are allowed to float, they are moved by the demagnetizing magnets to the most effective position for demagnetizing, and are correspondingly well demagnetized. In moving the workpieces through the apparatus, it will be appreciated that they do not rest on a moving component of the conveyor, but rather on the base or board 40 and are moved along by the paddles 48. These paddles loosely engage the workpieces, and do not hinder their movements, except to move them along. The workpieces are free to move sideways, or rotationally about vertical interior axes, and they are so moved according to the location and intensity of the regions of magnetism in the workpieces, in response to the action of the magnetic field of the demagnetizing magnet 61 itself. The base 40 is smooth, so as to enable the bearings to move easily as referred to. The workpieces will rotate due to the effect of the first magnet, and then when it reaches the second magnet, it will continue to be rotated in the same direction by that magnet, and as a result all elements of the workpiece are reached by the lines of the two fields, and thus become completely demagnetized. The angular positioning of the magnets, together with the floating feature of the workpieces, enhances the rotational effect and consequent thorough reaching of the magnetic lines into all elements of the workpieces.

In this instance, where the second magnet is positioned over the workpiece, after the workpiece moves past the first unit 50, and into the region of the next, the magnetic field of the second and upper demagnetizing magnet 62 lifts the workpiece from the bottom platform 40 upwardly and into engagement with the bottom member 59. They ride along that bottom member, and are held against it, in an action similar to their resting on the base element 40. In this case also, the paddles 48 do not hinder the movement of the workpieces, except to move them along longitudinally, and the workpieces are again able to freely move in other directions, i.e. sideways, and rotationally about interior axes. The demagnetizing effect therefore by the second and upper demagnetizing magnet 62 is closely similar to that of the first magnet 61.

We have found that the second unit 52 may also be placed under the workpieces, instead of above them, with good effect. Such an arrangement is shown in FIG. 9 where the unit 52*a*, essentially identical with the unit 52, constituting the second magnet, is positioned under the workpieces.

In both cases, i.e. relative to the demagnetizing magnets 61, 62, as the workpieces recede from the corresponding magnets, the effect of the magnetic field correspondingly diminishes, and particularly after passing by the second magnet 62, the effect of the field is diminished and the workpiece is completely demagnetized and it is not again brought within any magnetic field, the workpiece then being demagnetized as it leaves the unit 20.

We claim:

1. Demagnetizing apparatus comprising, conveyor means for conveying workpieces longitudinally along a path, demagnetizing magnets at spaced positions along the path, and arranged at 90° to each other and both at 45° to the line of conveyance, and the apparatus having means effective for presenting the workpieces at changing attitudes, aside from the longitudinal conveying movements, relative to the fields of magnetism of the magnets.

2. Demagnetizing apparatus according to claim 1 wherein, the means for so presenting the workpieces includes a floating relationship of the workpieces, independently of the conveyor means, enabling the workpieces to assume different attitudes in response to the fields of magnetism of the magnets.

3. Demagnetizing apparatus according to claim 2 wherein, the demagnetizing magnets are below and above the workpieces respectively.

4. Demagnetizing apparatus according to claim 3 wherein, the apparatus includes a supporting base capable of supporting the workpieces against gravity, and the magnet disposed above the workpieces is of sufficient strength to lift the workpieces from the supporting base.

5. Demagnetizing apparatus according to claim 4 wherein, the supporting base is stationary without moving parts, and the conveyor means having a movable component detachably engaging the workpieces and thereby operable for moving the workpieces along the path, but enabling the workpieces to move relative to the movable component bodily in transverse directions and rotationally about internal axes, whereby to assume said changing attitudes in response to the magnetic fields of the magnets.

6. Demagnetizing apparatus according to claim 5 wherein, the first demagnetizing magnet is below and closely adjacent said supporting base, the apparatus includes structure mounting the second demagnetizing magnet above the path and the structure including a bottom panel over the path and that demagnetizing magnet is above that bottom panel but closely adjacent thereto, the bottom panel being spaced above the supporting base a distance greater than the height of the workpieces, and the supporting base and bottom panel having relatively smooth surfaces for minimizing frictional resistance to movement of the workpieces thereover.

7. Demagnetizing apparatus according to claim 2, wherein, both of the magnets are below the workpieces.

8. A method of demagnetizing workpieces, comprising, moving the workpieces longitudinally along a path in a floating manner enabling them to move independently in different directions other than the longitudinal movement, and applying demagnetizing forces to the workpieces of sufficient strength to so move them in said different directions, and thereby produce demagnetizing effect in correspondingly different directions.

9. A method according to claim 8 and including the step, so positioning the demagnetizing forces by orienting demagnetizing magnetic fields at acute angles to the longitudinal along the path.

10. A method according to claim 8 and including the step, in at least a portion of the conveyance of the workpieces, applying a demagnetizing force from above of such strength as to lift the workpieces against the force of gravity.

11. A method according to claim 8 in demagnetizing workpieces of complex structure containing independent locations of magnetism, and including the step, so applying the demagnetizing forces in such strength as to move the workpieces according to the relation between the independent locations of magnetism and the demagnetizing forces and thereby produce demagnetizing effect according the orientation of those independent locations of magnetism after the workpieces are so moved.

* * * * *